US006802437B2

(12) United States Patent
Tsaur

(10) Patent No.: US 6,802,437 B2
(45) Date of Patent: Oct. 12, 2004

(54) CONTAINER

(76) Inventor: Garry Tsaur, 19222 Tranbarger St., Rowland Heights, CA (US) 91748

( * ) Notice: Subject to any disclaimer, the term of this patent is extended or adjusted under 35 U.S.C. 154(b) by 220 days.

(21) Appl. No.: 10/126,705

(22) Filed: Apr. 20, 2002

(65) Prior Publication Data

US 2003/0197036 A1 Oct. 23, 2003

(51) Int. Cl.[7] ..... G01F 11/06

(52) U.S. Cl. ..... 222/94; 222/107; 222/386; 222/387; 222/491

(58) Field of Search ..... 222/92, 94, 107, 222/386, 387, 491, 495, 496, 559

(56) References Cited

U.S. PATENT DOCUMENTS 79,723 A * 7/1868 Beach ..... 222/559
1,154,163 A * 9/1915 Ballou ..... 222/496
1,977,500 A * 10/1934 Tierman ..... 222/496
2,011,742 A * 8/1935 Weber ..... 222/496
2,158,375 A * 5/1939 Miller ..... 222/496
2,185,323 A * 1/1940 Arnold ..... 222/496
3,521,795 A * 7/1970 Finn et al. ..... 222/386

* cited by examiner

*Primary Examiner*—Kenneth Bomberg
(74) *Attorney, Agent, or Firm*—Joe Nieh

(57) ABSTRACT

The container of the present invention stores viscous substances in a sealed environment and is easily transportable. The contents of the container can be easily extracted completely without any tools or contact with the user. The container is an elongated housing with one or more opening near its ends and with one or more piston with approximately the same profile and dimension as the cross sectional profile of the interior of the elongated housing enclosed in the container that will slide along the length of the elongated housing when urged and extract the contents of the container completely.

7 Claims, 5 Drawing Sheets

CONTAINER

BACKGROUND—FIELD OF INVENTION

The present invention relates to a container for storing viscous substances and is easily transportable. The viscous substances contained within the container can be extracted easily and completely without using any tools and without contact with the user.

BACKGROUND—DESCRIPTION OF RELATED ART

Containers that enclose viscous substances to be stored and transported are often inconvenient to use and most requires an applicator or other tools to extract the viscous substance. One conventional design utilizes a soft container that can be squeezed to extract the content through an opening that is generally sealed with a screwed-on cap. This design requires that the user first unscrew the cap to expose the opening and then apply pressure to the body of the container to force the content out through the opening. This design does not allow complete extraction of the content of the container due to the fact that as pressure is applied to the body of the container, the content would spread out and some would always remain in the container even if the container is almost empty.

Another design uses a pump mechanism to physically pump the viscous substance through an opening that operates in conjunction with the pump mechanism such that as the pump mechanism is operated, the opening would open to allow the content to be extracted. This design is expensive to manufacture, and requires many small parts to be assembled.

SUMMARY OF THE INVENTION

The present invention is a container that stores viscous substances in a sealed environment and is easily transportable. The contents of the container can be easily extracted completely without any tools or contact with the user.

The present invention is an elongated container with one or more opening near its ends and with one or more piston with approximately the same profile and dimension as the cross sectional profile of the interior of the elongated housing enclosed in the container that will slide along the length of the elongated housing when urged and extract the contents of the container completely.

DETAILED DESCRIPTION OF THE PREFERRED EMBODIMENT

Figure 1:
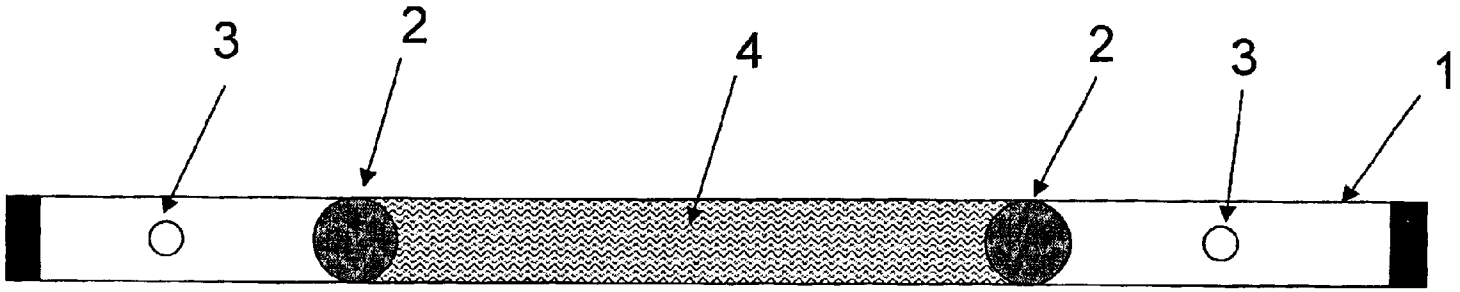
FIG. 1 shows the preferred embodiment of the container with two openings, one near each end of the elongated housing, and two pistons enclosing a viscous substance.

FIG. 1 shows the preferred embodiment of the container. The container has an elongated housing 1 with two ends. An opening 3 is located near each of the two ends. Two pistons 2 are enclosed within the elongated housing 1 with approximately the same profile and dimension as the interior profile and dimension of the elongated housing 1 and located between the two openings 3. The two pistons 2 enclose and seal a viscous substance 4 between them within the elongated housing 1. The viscous substance 4 is sealed within the elongated housing 1 until the pistons 2 are urged either by air pressure or physical force to move from their initial position.

The user may simply cover one of the opening 3 with their finger and apply pressure to the air chamber in the elongated housing 1 under the opening 3 at one end to generate an air pressure that will urge the pistons 2 to slide toward the other opening 3 at the opposite end of the elongated housing 1. Since fluids are incompressible, the viscous substance 4 will slide along the elongated housing 1 at the same rate and distance as the pistons 2. Once the piston 2 at the opposite end of the elongated housing 1 slides pass the opening 3 at the opposite end of the elongated housing 1, the viscous substance 4 will exit though the opening 3 at the opposite end of the elongated housing 1 for application. The piston 2 will also scrape the interior surfaces of the elongated housing 1 to completely extract all viscous substances 4 as it slides along the elongated housing 1. The user may also simply apply physical force by squeezing one end of the elongated housing 1 and physically push the piston 2 to slide toward the other end of the elongated housing 1 to achieve the same result.

Figure 2:
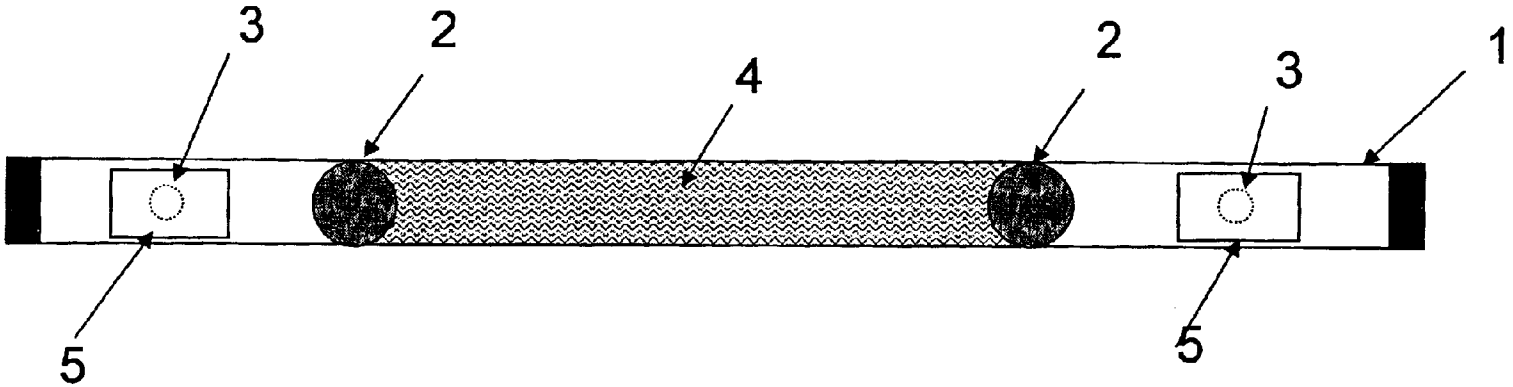
FIG. 2 shows another embodiment of the container with two openings that are sealed with covers, one near each end of the elongated housing, and two pistons enclosing a viscous substance.

FIG. 2 shows another embodiment of the container of FIG. 1 wherein each of the two openings 3 of the preferred embodiment is covered with a cover 5. The cover 5 will further seal the air chambers under the openings 3 to prevent contaminants from entering into the elongated housing 1 and results in a completely sealed elongated housing 1.

Figure 3:
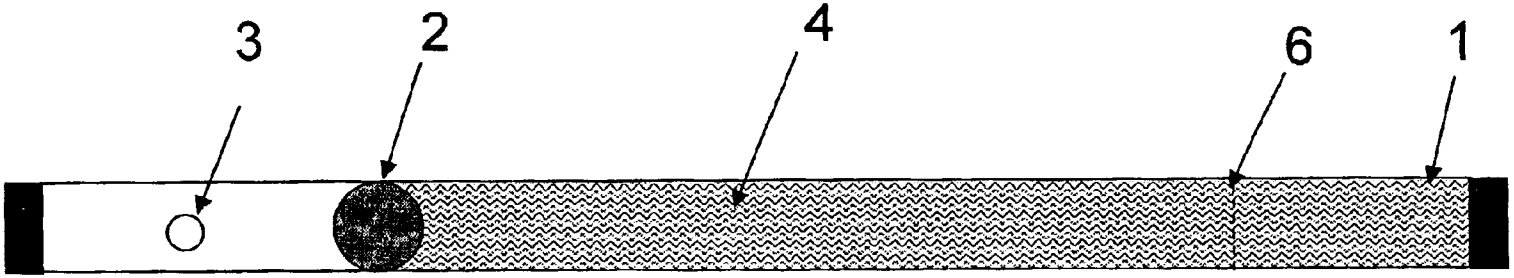
FIG. 3 shows another embodiment of the container with one opening near one end of the elongated housing and a piston enclosing a viscous substance against the unopened end of the elongated housing with a scoring near the unopened end.

FIG. 3 shows another embodiment of the container. The container has an elongated housing 1 with two ends. An opening 3 is located near one end of the elongated housing 1. A piston 2 is enclosed within the elongated housing 1 with approximately the same profile and dimension as the interior profile and dimension of the elongated housing 1 and located near the same end as the opening 3. The piston 2 enclose and seal a viscous substance 4 between the piston 2 and the other end of the elongated housing 1 without any openings but with a scoring 6 such that the elongated housing 1 can be broken open at the scoring 6 when bent. The viscous substance 4 is sealed within the elongated housing 1 until the elongated housing 1 is broken open at the scoring 6 and the piston 2 is urged either by air pressure or physical force to move from its initial position to force the viscous substance 4 out of the elongated housing 1.

Another variation of the embodiment shown in FIG. 3 utilize a pressure sensitive opening instead of a scoring 6 such that when the piston 2 is urged either by air pressure or physical force to move from its initial position to force the viscous substance 4 against the other end of the elongated housing 1 that is sealed with the pressure sensitive opening, the pressure sensitive opening will open due to the resulting pressure and allow extraction of the viscous substance 4 from the container. The pressure sensitive opening may be created by sealing the end of the elongated housing 1 with just sufficient force to prevent the viscous substance 4 from leaking from the elongated housing 1 but will break the seal if a predetermined amount of pressure is applied to the pressure sensitive seal.

Figure 4:
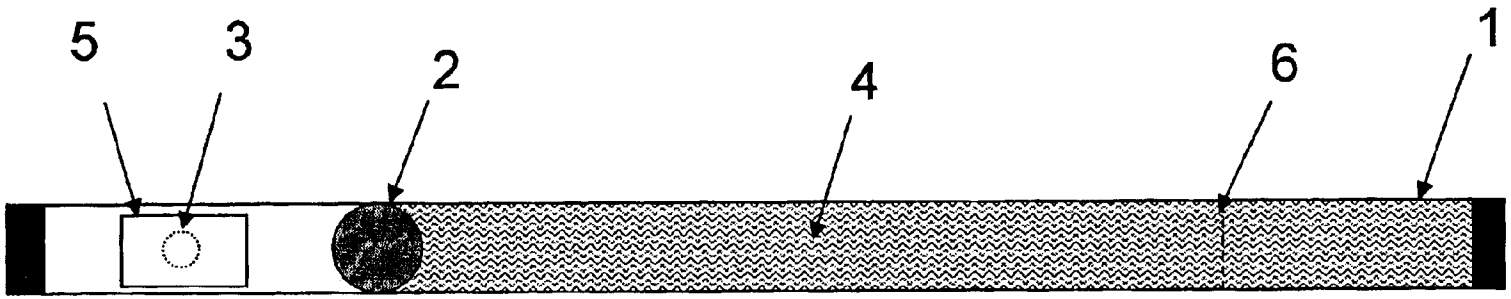
FIG. 4 shows another embodiment of the container with one opening that is covered near one end of the elongated housing and a piston enclosing a viscous substance against the unopened end of the elongated housing with a scoring near the unopened end.

FIG. 4 shows another embodiment of the container of FIG. 3 wherein the opening 3 is covered with a cover 5. The cover 5 will further seal the air chamber under the opening 3 to prevent contaminants from entering into the elongated housing 1 and results in a completely sealed elongated housing 1.

Figure 5:
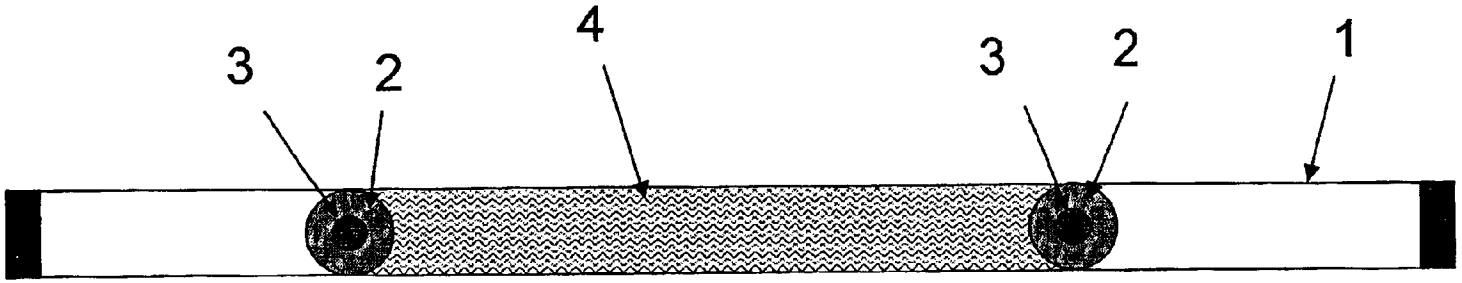
FIG. 5 shows another embodiment of the container with two openings, one near each end of the elongated housing, and two pistons located at the same location as the openings and sealing the openings, enclosing a viscous substance.
Figure 6:
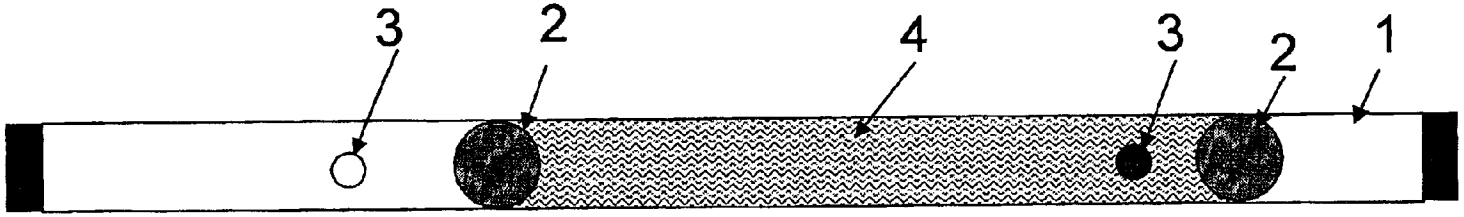
FIG. 6 shows the position of the pistons after they are urged away from the openings to extract the contents of the elongated housing.

FIG. 5 shows another embodiment of the container. The container has an elongated housing 1 with two ends. An opening 3 is located near each of the two ends. Two pistons 2 are enclosed within the elongated housing 1 with approximately the same profile and dimension as the interior profile and dimension of the elongated housing 1 with one piston 3 located under each of the opening 3 thereby sealing the openings 3. The two pistons 2 enclose and seal a viscous substance 4 between them within the elongated housing 1. The viscous substance 4 is sealed within the elongated housing 1 until the pistons 2 are urged either by air pressure or physical force to move from their initial position as shown in FIG. 6. When the user squeezes either end of the elongated housing 1, the resulting pressure will urge the pistons 3 to slide away from their initial position toward the other end of the elongated housing 1. Since fluids are incompressible, the viscous substance 4 will slide along the elongated housing 1 at the same rate and distance as the pistons 2. Once the piston 2 at the opposite end of the elongated housing 1 slides away from the opening 3 at the opposite end, the viscous substance 4 will exit though the opening 3 at the opposite end of the elongated housing 1 for application. The piston 2 will also scrape the interior surfaces of the elongated housing 1 to completely extract all viscous substances 4 as it slides along the elongated housing 1.

Figure 7:
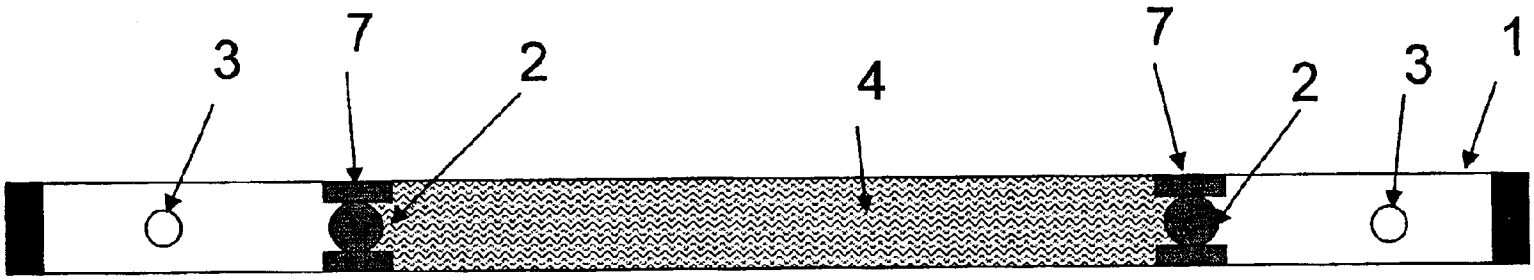
FIG. 7 shows another embodiment of the container with two openings, one near each end of the elongated housing, and two pistons retained in a retained position by restrictor and enclosing a viscous substance.
Figure 8:
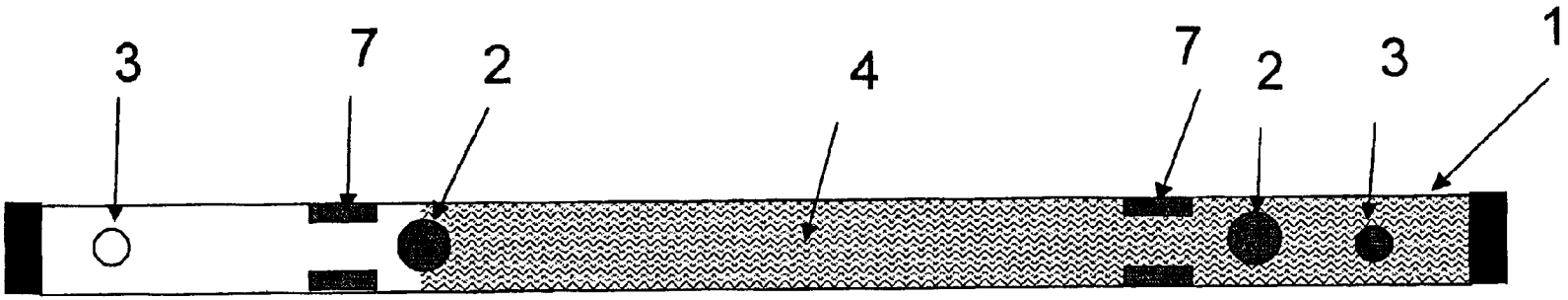
FIG. 8 shows the position of the pistons after they are urged away from their retained position to extract the contents of the elongated housing.

FIG. 7 shows another embodiment of the container. The container has an elongated housing 1 with two ends. An opening 3 is located near each of the two ends. Two pistons 2 are enclosed within the elongated housing 1 with a smaller dimension than the interior dimension of the elongated housing 1 and retained at their predetermined locations by a restrictor 7 and located between the two openings 3. The two pistons 2 enclose and seal a viscous substance 4 between them within the elongated housing 1. The viscous substance 4 is sealed within the elongated housing 1 until the pistons 2 are urged either by air pressure or physical force to move from their predetermined position at the restrictor 7. Once the pistons 2 separate from the restrictor 7 they will allow free movement of the viscous substance 4 within the elongated housing 1. As shown in FIG. 8, depending on the orientation of the container, the viscous substance 4 may exit from either opening 3.

Figure 9:
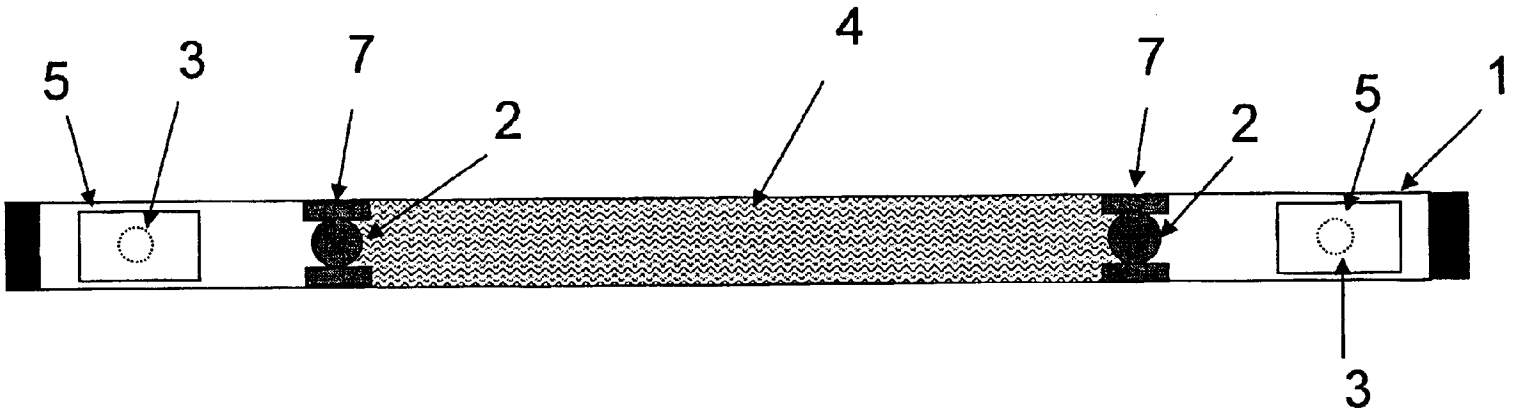
FIG. 9 shows another embodiment of the container with two openings that are covered, one near each end of the elongated housing, and two pistons retained in a retained position by restrictor and enclosing a viscous substance.
Figure 10:
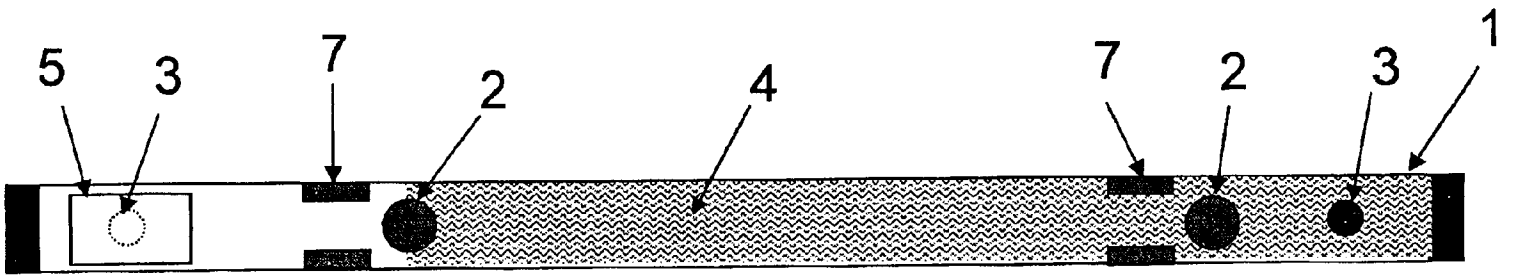
FIG. 10 shows the position of the pistons after they are urged away from their retained position to extract the contents of the elongated housing.

FIG. 9 shows another embodiment of the container of FIG. 7 wherein each of the two openings 3 is covered with a cover 5. The cover 5 will further seal the air chambers under the openings 3 to prevent contaminants from entering into the elongated housing 1 and results in a completely sealed elongated housing 1. Furthermore, the resulting sealed air chamber may be pressurized to a positive pressure or a negative pressure such that when one cover 5 is removed, the air pressure, whether positive or negative, in the remaining sealed air chamber will urge the pistons 2 to slide away from their initial position at the restrictors 7 and allow free movement of the viscous substance 4 within the elongated housing 1 and exit thought the opening 3 as shown in FIG. 10.

What is claimed is:

1. A container comprising:

an elongated housing with two or more openings;

two or more piston A1 enclosed within said elongated housing with approximately the same profile and dimension as the cross sectional profile of the interior of the elongated housing that will slide along the length of the elongated housing when urged and separating the interior of the elongated housing into chambers;

wherein the two or more pistons will retain a viscous substance within said elongated housing separating the viscous substance from two or more air chambers under the two or more openings, and when the two or more pistons are urged to move from their positions the viscous substance will enter one of the two air chambers and exit through one of the two openings in the elongated housing.

2. A container as in claim 1, wherein the two or more openings on the elongated housing are covered with covers.

3. A container as in claim 1, wherein the two or more openings on the elongated housing are blocked by the two or more pistons enclosed within said elongated housing wherein when the two or more pistons are urged to move from their positions the viscous substances will exit through one of the two openings on the elongated housing.

4. A container as in claim 1, wherein the two or more pistons are each positioned at a retained position at a predetermined locations along the length of the elongated housing by a restrictor that reduces the internal cross sectional area of the elongated housing at the predetermined location wherein when the two or more pistons are urged to move from their retained positions the viscous substance will exit through one of the two or more openings on the elongated housing.

5. A container as in claim 4, wherein the two or more openings on the elongated housing are covered with covers.

6. A container as in claim 5, wherein the two or more air chambers in the elongated housing are positively pressurized by air pressure wherein after one of the covers are removed, the air pressure in the remaining chamber will urge the two or more pistons to move from their retained positions away from the remaining chamber and allow the viscous substance to exit through one of the two openings with the cover removed.

7. A container as in claim 5, wherein the two or more air chambers in the elongated housing are negatively pressurized by a partial vacuum wherein after one of the covers are removed, the vacuum in the remaining chamber will urge the two or more pistons to move from their retained positions toward it and allow the viscous substance to exit through the opening with the cover removed.

* * * * *